US008879941B2

(12) United States Patent
Meguro

(10) Patent No.: US 8,879,941 B2
(45) Date of Patent: Nov. 4, 2014

(54) CLEANING DEVICE AND IMAGE FORMING APPARATUS

(75) Inventor: Taichi Meguro, Tokyo (JP)

(73) Assignee: Konica Minolta Business Technologies, Inc. (JP)

( * ) Notice: Subject to any disclaimer, the term of this patent is extended or adjusted under 35 U.S.C. 154(b) by 173 days.

(21) Appl. No.: 13/613,293

(22) Filed: Sep. 13, 2012

(65) Prior Publication Data

US 2013/0084095 A1 Apr. 4, 2013

(30) Foreign Application Priority Data

Oct. 3, 2011 (JP) ..... 2011-218916

(51) Int. Cl.
*G03G 15/16* (2006.01)
*G03G 21/00* (2006.01)

(52) U.S. Cl.
CPC ..... *G03G 15/161* (2013.01); *G03G 21/0035* (2013.01)
USPC ..... 399/71; 399/101; 399/349; 399/353; 399/354

(58) Field of Classification Search
USPC ..... 399/71, 101, 349, 353, 354
See application file for complete search history.

(56) References Cited

U.S. PATENT DOCUMENTS

| | | | | |
|---|---|---|---|---|
| 5,652,951 | A * | 7/1997 | Thayer et al. | 399/71 |
| 2007/0059028 | A1* | 3/2007 | Nishikawa | 399/101 |
| 2010/0150602 | A1* | 6/2010 | Sano et al. | 399/101 |
| 2011/0158677 | A1* | 6/2011 | Kikuchi et al. | 399/101 |
| 2011/0229187 | A1* | 9/2011 | Hozumi et al. | 399/101 |
| 2012/0008973 | A1* | 1/2012 | Sakakibara et al. | 399/101 |
| 2012/0034006 | A1* | 2/2012 | Asaoka et al. | 399/343 |

FOREIGN PATENT DOCUMENTS

| | | |
|---|---|---|
| JP | 2007-72398 A | 3/2007 |
| JP | 2009-36957 A | 2/2009 |

* cited by examiner

*Primary Examiner* — Ryan Walsh
(74) *Attorney, Agent, or Firm* — Cantor Colburn LLP

(57) ABSTRACT

A cleaning device and an image forming apparatus capable of suppressing staying of toner in a brush and reducing stress on a brush by discharge products are provided. A cleaning device includes upstream and downstream cleaning brushes and a cleaning roller, which respectively contact the surface of a secondary transfer belt, and first to third bias applying sections. The first bias applying section applies a bias voltage having a polarity opposite to that of the normal toner to the upstream cleaning brush. The second bias applying section applies a bias voltage having a polarity opposite to that of the normal toner and set to be not less than the absolute value of the bias voltage applied to the upstream cleaning brush, to the downstream cleaning brush. The third bias applying section applies a bias voltage having the same polarity as that of the normal toner to the cleaning roller.

11 Claims, 9 Drawing Sheets

CLEANING DEVICE AND IMAGE FORMING APPARATUS

CROSS REFERENCES TO RELATED APPLICATIONS

The present invention contains subject matter related to Japanese Patent Application JP 2011-218916, filed in the Japanese Patent Office on Oct. 3, 2011, the entire contents of which being incorporated herein by reference.

BACKGROUND OF THE INVENTION

1. Field of the Invention

The present invention relates to a cleaning device for removing toner adhering to a moving body, and an image forming apparatus provided with the cleaning device.

2. Description of the Related Art

In image forming apparatuses such as copiers, printers, facsimile devices, and composite machines thereof, a moving body to which toner adheres is used. Examples of such moving bodies include a photosensitive body on which a toner image is formed, an intermediate transfer body to which the toner image formed on the photosensitive body is transferred, a transfer member that transfers the toner image having been transferred to the intermediate transfer body to a sheet in a transfer position.

It should be noted that no toner image is formed on the transfer member. However, when images are to be formed on both sides of a sheet, one side (surface) of the sheet on which an image has been formed in advance contacts the transfer member, and thus the toner on the surface of the sheet may sometimes adhere to the transfer member.

Toner remaining on the photosensitive body or on the intermediate transfer body after transfer of a toner image, or toner adhering to the transfer member is removed by a cleaning device. Such a cleaning device is disclosed, for example, in Japanese Unexamined Patent Application Publication Nos. 2007-72398 and 2009-36957.

A cleaning device disclosed in Japanese Unexamined Patent Application Publication No. 2007-72398 has a plurality of brush rollers that abut to the surface of an image carrier which is a moving body, and applies bias voltages having polarities different from each other to at least two brush rollers. Then, the surface velocity of a brush roller, to which a bias voltage having a polarity opposite to the normal charging polarity of the toner, is applied, is set to be quicker than the surface velocity of a brush roller, to which a bias voltage having the same polarity as the normal charging polarity of the toner is applied.

A cleaning device disclosed in Japanese Unexamined Patent Application Publication No. 2009-36957 includes a first brush member, a second brush member, and a third brush member that respectively contact the surface of an image holding member which is a moving body. The second brush member is arranged on the downstream side of the first brush member in the moving direction of the image holding member, and the third brush member is arranged on the downstream side of the second brush member in the moving direction of the image holding member. Then, to the first brush member and the second brush member, bias voltages having different polarities are applied, and the mechanical scraping force of the third brush member is made stronger than mechanical scraping forces of the first and second brush members.

SUMMARY OF THE INVENTION

However, in cleaning devices respectively disclosed in Japanese Unexamined Patent Application Publication Nos. 2007-72398 and 2009-36957, the brush (roller or member) arranged on the uppermost upstream side in the moving direction of the moving body first removes the toner remaining on the moving body. Therefore, into the brush arranged on the uppermost upstream side, toner exceeding the toner recovery function of the brush might enter. Then, when toner exceeding the toner recovery function of the brush arranged on the uppermost upstream side enters into the brush arranged on the uppermost upstream side, there occurs such problems that toner which is not recovered but stays in the brush adheres again to the image holding member (or carrier), or increases the resistance of the brush.

Moreover, since it is necessary to set the bias voltage to be applied to the brush to be high in order to remove a lot of toner on the image holding member, discharge is induced, and discharge products may sometimes adhere to the image holding member or the brush.

In consideration of actual circumstances in the above-mentioned prior art, an object of the present invention is to provide a cleaning device and an image forming apparatus that can suppress staying of toner on a brush and that can reduce stress on the brush caused by discharge products.

In order to solve the above-described problems and to achieve the object of the present invention, a cleaning device reflecting one aspect of the present invention includes an upstream cleaning brush, a downstream cleaning brush, a cleaning roller, a first bias applying section, a second bias applying section, and a third bias applying section.

The upstream cleaning brush is in contact with the surface of a moving body to which toner adheres.

The downstream cleaning brush is arranged on the downstream side of the upstream cleaning brush in the moving direction of the moving body, and is in contact with the surface of the moving body.

The cleaning roller is arranged on the downstream side of the downstream cleaning brush in the moving direction of the moving body, and is in contact with the surface of the moving body.

The first bias applying section applies a bias voltage having a polarity opposite to the polarity of the normal toner, to the upstream cleaning brush.

The second bias applying section applies a bias voltage that has a polarity opposite to the polarity of the normal toner and that is set to be not less than the absolute value of the bias voltage applied to the upstream cleaning brush, to the downstream cleaning brush.

The third bias applying section applies a bias voltage having the same polarity as that of the normal toner to the cleaning roller.

Furthermore, an image forming apparatus reflecting one aspect of the invention includes a moving body, to the surface of which toner adheres, and the above-mentioned cleaning device for removing the toner adhering to the moving body.

In the cleaning device and the image forming apparatus of the invention, by the upstream cleaning brush and the downstream cleaning brush, normally charged toner adhering to the surface of the moving body is removed. Accordingly, even when a lot of toner adhering to the surface of the moving body is to be removed, a lot of toner is not required to be removed at a time, and thus the bias voltage applied to each of cleaning brushes can be controlled to be low. Consequently, the induction of discharge can be suppressed and stress on brushes due to discharge products can be reduced.

Furthermore, in the cleaning device and the image forming apparatus of the invention, the absolute value of the bias voltage applied to the downstream cleaning brush is set to be not less than the absolute value of the bias voltage applied to the upstream cleaning brush. Consequently, a certain amount of toner is also removed in the downstream cleaning brush, and thus it is possible not to concentrate a load with respect to the toner removal on the upstream cleaning brush. As a result, it is possible for toner exceeding the toner recovery function not to enter into the upstream cleaning brush, and to suppress staying of toner on the upstream cleaning brush.

Moreover, in the cleaning device and the image forming apparatus of the invention, a bias voltage having the same polarity as that of the normal toner is applied to the cleaning roller, and thus toner charged with a polarity opposite to a normal polarity, and wax and a lubricant added to the toner can be removed by the cleaning roller. As a result, it is possible to prevent or suppress generation of filming, in which toner, and wax and a lubricant added to the toner are firmly fixed in a film shape on the surface of the moving body.

DESCRIPTION OF THE PREFERRED EMBODIMENTS

Figure 1:
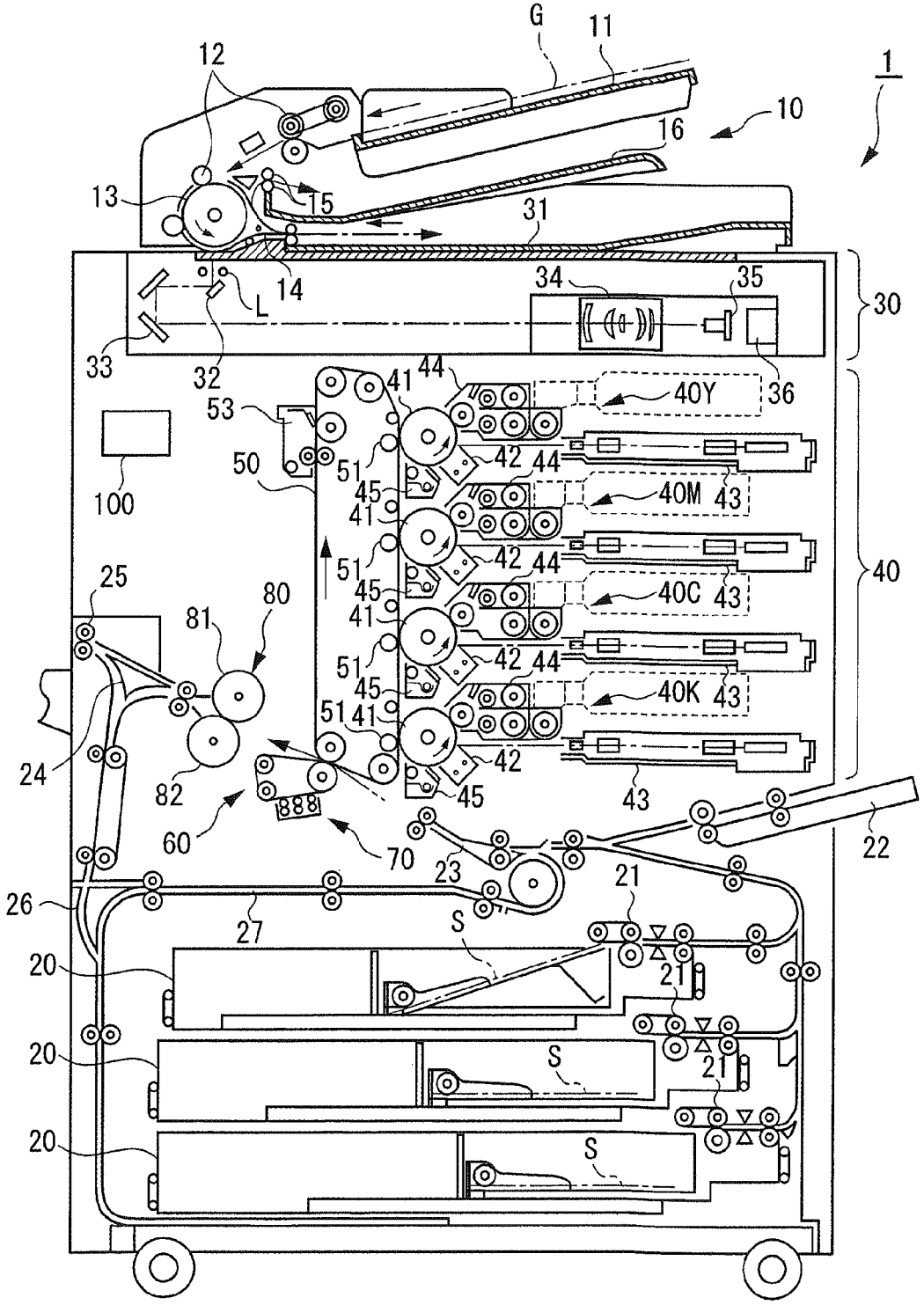
FIG. 1 is a whole configuration diagram showing a first embodiment of the image forming apparatus of the invention.

Hereinafter, embodiments for practicing a cleaning device and an image forming apparatus will be described with reference to FIGS. 1 to 11. It should be noted that the same reference numerals are given to common members in each of drawings. In addition, the description will be given in the following order.

1. The first embodiment of the image forming apparatus
2. The second embodiment of the image forming apparatus
3. The third embodiment of the image forming apparatus
4. The fourth embodiment of the image forming apparatus

1. First Embodiment of Image Forming Apparatus

[Configuration Example of Image Forming Apparatus]

First, a configuration example of the first embodiment of the image forming apparatus will be described with reference to FIG. 1.

FIG. 1 is a whole configuration diagram showing the first embodiment of the image forming apparatus.

As shown in FIG. 1, an image forming apparatus 1 forms an image on a sheet by an electrophotographic system, and is a color image forming apparatus of a tandem style, in which 4 color toners of yellow (Y), magenta (M), cyan (C), and black (Bk) are superimposed one on top of another. The image forming apparatus 1 has an original document feeding section 10, a sheet accommodation section 20, an image reading section 30, an image forming section 40, an intermediate transfer belt 50, a secondary transfer section 60, a cleaning device 70, a fixing section 80, and a control board 100.

The original document feeding section 10 has an original document feeding table 11 for setting an original document, a plurality of rollers 12, a feed drum 13, a feed guide 14, an original document ejection roller 15, and an original document ejection tray 16. Original documents G set on the original document feeding table 11 are fed one by one to the reading position of the image reading section 30 by the plurality of rollers 12 and the feed drum 13. The feed guide 14 and the original document ejection roller 15 eject an original document G having been fed by the plurality of rollers 12 and the feed drum 13, to the original document ejection tray 16.

The image reading section 30 reads the image of the original document G fed by the original document feeding section 10, or the image of an original document placed on an original document table 31, to thereby generate image data. Specifically, the image of the original document G, for example, is irradiated by a lamp L. The light reflected from the original G is guided to a first mirror unit 32, a second mirror unit 33, and a lens unit 34, in that order, to form an image on a light receiving surface of an image pickup device 35. The image pickup device 35 photoelectrically converts the entering light and outputs a prescribed image signal. The outputted image signal is produced as image data, after having been subjected to A/D conversion.

In addition, the image reading section 30 has an image reading control section 36. The image reading control section 36 provides processing, such as shading correction, dither processing, compression, etc. to the image data produced by A/D conversion, and stores the processed image data in a RAM 103 of the control substrate 100 (see FIG. 4). Meanwhile, image data is not limited to data outputted from the image reading section 30, but may be data received from an external apparatus, such as a personal computer, another image forming apparatus, etc. connected to the image forming apparatus 1.

The sheet accommodation section 20 is arranged in the lower section of the apparatus main body, and a plurality of the sheet accommodation sections 20 is provided according to sizes or kinds of sheets S. Each sheet S is fed by a sheet feeding section 21 and is conveyed to a conveyance section 23, and is then conveyed to a secondary transfer section 60 having a transfer position, by the conveyance section 23. In addition, near the sheet accommodation section 20, a manual sheet feeding section 22 is provided. From the manual sheet feeding section 22, a sheet of a size not accommodated in the sheet accommodation section 20, a tag sheet having a tag, or a special sheet such as an OHP sheet, etc. is conveyed to the transfer position.

Between the image reading section 30 and the sheet accommodation section 20, the image forming section 40 and the intermediate transfer belt 50 are arranged. The image forming section 40 has four image forming units 40Y, 40M, 40C, and 40K for forming toner images of respective colors of yellow (Y), magenta (M), cyan (C), and black (Bk).

A first image forming unit 40Y forms a yellow toner image, and a second image forming unit 40M forms a magenta toner image. Furthermore, a third image forming unit 40C forms a cyan toner image, and a fourth image forming unit 40K forms a black toner image. Since these four image forming units 40Y, 40M, 40C, and 40K have the same configuration, here, the first image forming unit 40Y will be described.

The first image forming unit 40Y has a drum-shaped photosensitive body 41, a charging section 42 arranged around the photosensitive body 41, an exposure section 43, a developing section 44, and a cleaning section 45. The photosensitive body 41 is rotated by a drive motor not shown. The charging section 42 applies charges to the photosensitive body 41 to uniformly charge the surface of the photosensitive body 41. The exposure section 43 performs an exposure operation on the surface of the photosensitive body 41, on the basis of image data read from the original document G or image data transmitted from an external apparatus, to thereby form an electrostatic latent image on the photosensitive body 41.

The developing section 44 causes a yellow toner charged with a normal polarity to adhere to the latent image formed on the photosensitive body 41. Consequently, on the surface of the photosensitive body 41, a yellow toner image is formed. Meanwhile, the developing section 44 of the second image forming unit 40M causes a magenta toner similarly charged with the normal polarity to adhere to a latent image formed on the photosensitive body 41 of the second image forming unit 40M, and the developing section 44 of the third image forming unit 40C causes a cyan toner charged with the normal polarity to adhere to a latent image formed on the photosensitive body 41 of the third image forming unit 40C. Then, the developing section 44 of the fourth image forming unit 40K causes a black toner charged with the normal polarity to adhere to a latent image formed on the photosensitive body 41 of the fourth image forming unit 40K.

The cleaning section 45 removes toner remaining on the surface of the photosensitive body 41.

A toner image formed on the photosensitive body 41 is transferred to the intermediate transfer belt 50 as an example of an intermediate transfer body. The intermediate transfer belt 50 is formed in an endless shape, and is spanned over a plurality of rollers. The intermediate transfer belt 50 is driven by a motor not shown to rotate in a direction opposite to the rotation (moving) direction of the photosensitive body 41.

In the intermediate transfer belt 50, in positions facing respective photosensitive bodies 41 of the image forming units 40Y, 40M, 40C, and 40K, primary transfer sections 51 are provided, respectively. Each primary transfer section 51 applies a polarity opposite to that of the toner charged with the normal polarity and caused by the corresponding developing section 44 to adhere to a latent image formed on the corresponding photosensitive body 41 to thereby form a toner image thereupon to the intermediate transfer belt 50. Thereby, the toner image formed on the photosensitive body 41 is transferred to the intermediate transfer belt 50.

Then, by rotationally driving the intermediate transfer belt 50, respective toner images formed by four image forming units 40Y, 40M, 40C, and 40K are sequentially transferred onto the surface of the intermediate transfer belt 50. Consequently, on the intermediate transfer belt 50, the toner images of yellow, magenta, cyan, and black are superimposed one on top of another and thereby a color toner image is formed.

Furthermore, a belt cleaning device 53 faces the intermediate transfer belt 50. The belt cleaning device 53 cleans the surface of the intermediate transfer belt 50 that has finished transfer of a color toner image formed on the intermediate transfer belt 50 to a sheet S.

Near the intermediate transfer belt 50 and on the downstream side in the sheet conveyance direction of the conveyance section 23, the secondary transfer section 60 is arranged. The secondary transfer section 60 causes a sheet S conveyed by the conveyance section 23 to contact the intermediate transfer belt 50, to thereby transfer a toner image formed on the outer surface of the intermediate transfer belt 50 to the sheet S. The cleaning device 70 faces the secondary transfer section 60. The secondary transfer section 60 and the cleaning device 70 will be described in detail later.

On the sheet ejection side of the secondary transfer section 60 where the sheet S is ejected, the fixing section 80 is provided. The fixing section 80 pressurizes and heats the sheet S ejected from the secondary transfer section 60 to fix a transferred toner image on the sheet S to the sheet S. The fixing section 80 is configured, for example, by a fixing upper roller 81 and a fixing lower roller 82 as a pair of fixing members. The fixing upper roller 81 and the fixing lower roller 82 are arranged in a state of being pressed against each other, and a fixing nip section is formed by parts of the fixing upper roller 81 and the fixing lower roller 82 pressed against each other.

Inside the fixing upper roller 81, a heating section is provided. Radiation heat from the heating section heats a roller section of the fixing upper roller 81. Then, the heat of the roller section of the fixing upper roller 81 is transmitted to the sheet S conveyed to the fixing nip section, and thereby a toner image on the sheet S is thermally fixed.

The sheet S is fed so that the surface on which a toner image has been transferred by the secondary transfer section 60 (the surface to be subjected to fixing) faces the fixing upper roller 81, and passes through the fixing nip section. Accordingly, the sheet S that passes through the fixing nip section is subjected to pressurization by the fixing upper roller 81 and the fixing lower roller 82, and to heating by the heat of the roller section of the fixing upper roller 81.

On the downstream side of the fixing section 80 in the sheet conveyance direction, a switching gate 24 is arranged. The switching gate 24 switches the conveyance path of the sheet S having passed through the fixing section 80. That is, the switching gate 24 causes the sheet S to go straight ahead when face-up (image-side up) ejection is to be performed in one-side image forming. Consequently, the sheet S is ejected by a pair of ejection rollers 25. In addition, the switching gate 24 guides the sheet S downward when face-down (image-side down) ejection in one-side image forming, and both-side image forming are to be performed.

When the face-down ejection is to be performed, the switching gate 24 guides the sheet S downward, and thereafter, a sheet reversing and conveying section 26 reverses front and rear surfaces of the sheet S, and conveys the sheet S upward. Consequently, the sheet S with reversed front and rear surfaces is ejected by the pair of ejection rollers 25.

When both-side image forming is to be performed, after guiding the sheet S downward by the switching gate 24, the sheet reversing and conveying section 26 reverses front and rear surfaces of the sheet S, and the sheet S is conveyed again to the transfer position through a sheet re-feeding path 27.

On the downstream side of the pair of ejection rollers 25, a post-processing device for folding the sheet S, or for performing staple processing and the like on the sheet S may be arranged.

[Secondary Transfer Section]

Next, the secondary transfer section 60 will be described with reference to FIG. 2.

Figure 2:
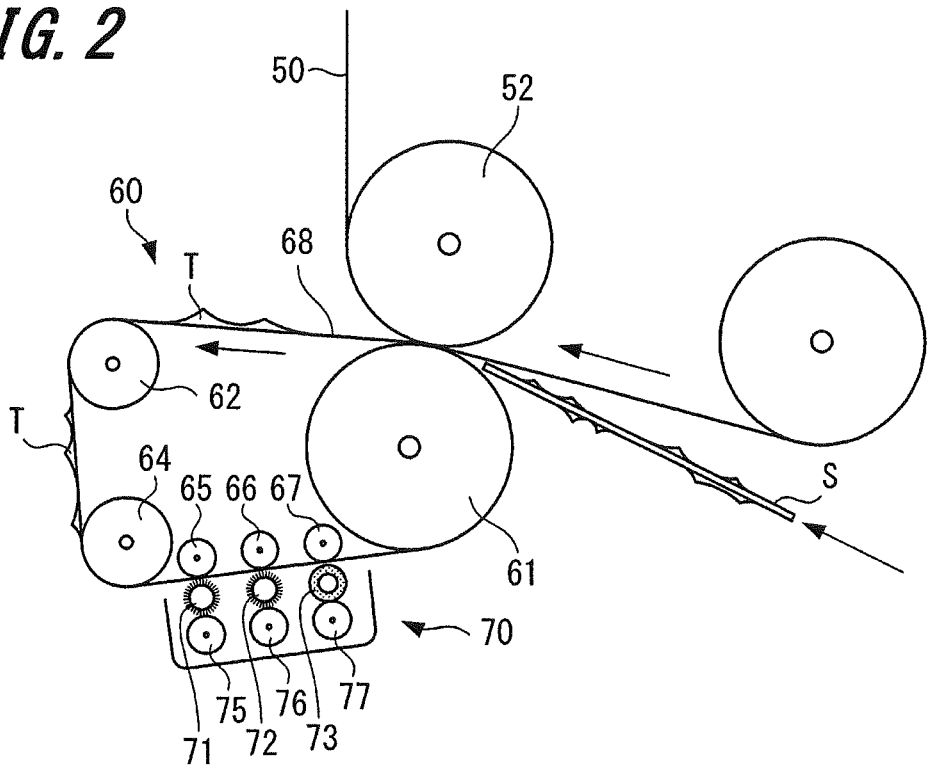
FIG. 2 is an explanatory view showing a secondary transfer section and a cleaning device according to the first embodiment of the image forming apparatus of the invention.

FIG. 2 is an explanatory view showing the secondary transfer section 60 and the cleaning device 70.

As shown in FIG. 2, the secondary transfer section 60 includes a secondary transfer roller 61, a driving roller 62, driven rollers 64, 65, 66 and 67, and a secondary transfer belt 68. The secondary transfer roller 61 is pressed against a secondary transfer facing roller 52 via the secondary transfer belt 68 and the intermediate transfer belt 50. Then, a nip section where the secondary transfer belt 68 contacts the intermediate transfer belt 50 works as a transfer position for transferring a toner image formed on the outer surface of the intermediate transfer belt 50, to a sheet S.

The driving roller 62 is rotated by a rotary driving section (not shown) such as a motor, etc. The driven rollers 65, 66, and 67 respectively face an upstream cleaning brush 71, a downstream cleaning brush 72, and a cleaning roller 73 of the cleaning device 70, which are to be described later, via the secondary transfer belt 68. These driven rollers 65, 66, and 67 are connected to the ground (GND) (see FIG. 3).

The secondary transfer belt 68 is spanned over the secondary transfer roller 61, the driving roller 62, and the driven rollers 64 to 67, and is configured rotatably in a direction corresponding to the sheet conveyance direction. The secondary transfer belt 68 rotates by driving of the driving roller 62, to convey the sheet S to the transfer position.

The secondary transfer belt 68 is shown as an example of the moving body according to the invention, to which toner adheres. On the secondary transfer belt 68, no toner image is formed. However, for example, when images (toner images) are to be formed on both sides of a sheet S, one side (surface) of the sheet S on which an image (toner image) has been formed in advance, contacts the secondary transfer belt 68, and thus toner of the toner image on one side (surface) of the sheet S may sometimes adhere to the secondary transfer belt 68. Toner T adhering to the secondary transfer belt 68 is removed by the cleaning device 70.

[Cleaning Device]

Next, the cleaning device 70 will be described with reference to FIGS. 2 and 3.

Figure 3:
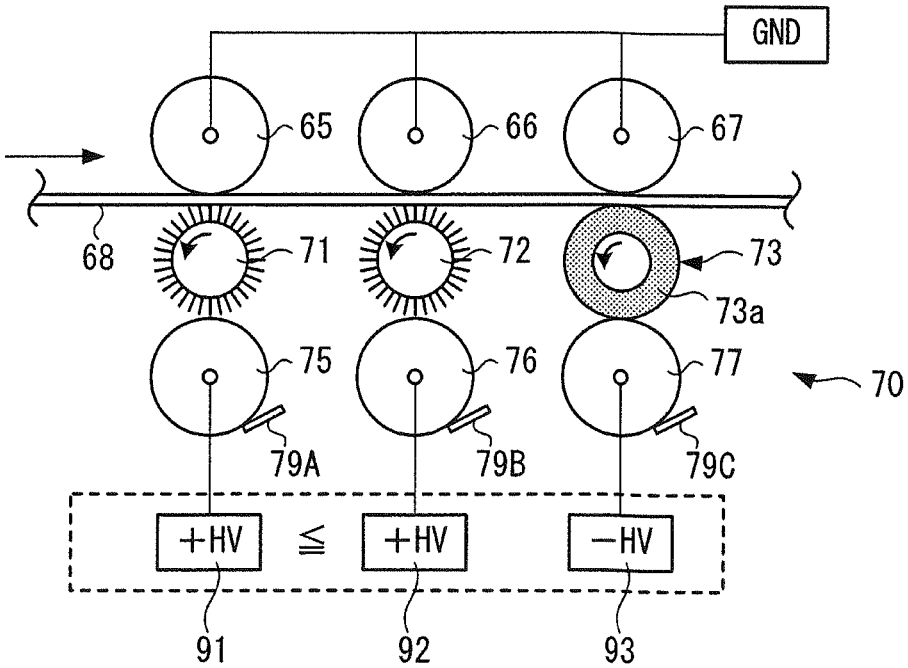
FIG. 3 is a rough configuration diagram showing the cleaning device according to the first embodiment of the image forming apparatus of the invention.

FIG. 3 is a rough configuration diagram showing the cleaning device 70.

The cleaning device 70 includes the upstream cleaning brush 71, the downstream cleaning brush 72, the cleaning roller 73 having elasticity, a first bias applying section 75, a second bias applying section 76, and a third bias applying section 77.

The upstream cleaning brush 71 contacts the secondary transfer belt 68, and faces the driven roller 65 with the secondary transfer belt 68 interposed therebetween. The upstream cleaning brush 71 is an electroconductive brush, and is rotated by a rotary driving section (not shown) such as a motor, etc. in a direction opposite to the direction of rotation (moving) of the secondary transfer belt 68. Then, the brush 71 removes adhering substances such as toner, etc. adhering to the surface of the secondary transfer belt 68, by an electric attraction and a mechanical scraping force.

The downstream cleaning brush 72 is arranged on the downstream side of the upstream cleaning brush 71 in the moving direction of the secondary transfer belt 68. That is, the downstream cleaning brush 72 is arranged on the downstream side of the upstream cleaning brush 71 in the moving (rotation) direction of the secondary transfer belt 68, with the nip section where the secondary transfer belt 68 contacts the intermediate transfer belt 50 served as the uppermost upstream side.

The downstream cleaning brush 72 contacts the secondary transfer belt 68 and faces the driven roller 66 with the secondary transfer belt 68 interposed therebetween. Furthermore, the downstream cleaning brush 72 is an electroconductive brush in the same manner as the upstream cleaning brush 71, and is rotated in a direction opposite to the rotation (moving) direction of the secondary transfer belt 68, by a rotary driving section (not shown) such as a motor, etc. Then, the brush 72 removes adhering substance such as toner, etc. adhering to the surface of the secondary transfer belt 68, by an electric attraction and a mechanical scraping force.

As the material of the upstream cleaning brush 71 and the downstream cleaning brush 72, for example, a resin, such as nylon resin, polyester resin, acrylic resin, vinylon resin, etc, can be applied. A combination of two or more of nylon resin, polyester resin, acrylic resin, vinylon resin, and the like can also be applied.

The cleaning roller 73 is arranged on the downstream side of the downstream cleaning brush 72 in the moving direction of the secondary transfer belt 68. That is, the cleaning roller 73 is arranged on the downstream side of the downstream cleaning brush 72 in the moving (rotation) direction of the secondary transfer belt 68, with the nip section where the secondary transfer belt 68 contacts the intermediate transfer belt 50 served as the uppermost upstream side.

The cleaning roller 73 contacts the secondary transfer belt 68 and faces the driven roller 67 with the secondary transfer belt 68 interposed therebetween. The cleaning roller 73 has a periphery section 73*a* formed of an elastic member, and the periphery section 73*a* contacts the secondary transfer belt 68.

Examples of materials of the elastic member forming the periphery section 73*a* of the cleaning roller 73 can include urethane foam, polyurethane, sponge members, rubber members, etc.

The cleaning roller 73 is rotated in a direction opposite to the rotation (moving) direction of the secondary transfer belt 68, by a rotary driving section (not shown) such as a motor, etc. Then, the cleaning roller 73 removes adhering substances, such as toner, wax and a lubricant added to the toner, etc, adhering to the surface of the secondary transfer belt 68, by an electric attraction and a mechanical scraping force.

As shown in FIG. 3, the first bias applying section 75 is formed in a shape of a roller that rotates in contact with the upstream cleaning brush 71. The first bias applying section 75 is electrically connected with a first power source section 91. Then, when a bias voltage is supplied from the first power source section 91, the first bias applying section 75 applies the bias voltage to the upstream cleaning brush 71.

The first power source section 91 outputs a bias voltage (+HV) having a polarity opposite to that of the toner charged with a normal polarity and caused by each developing section 44 to adhere to a latent image on the corresponding photosensitive body 41 to form a toner image (hereinafter referred to as the normal toner). The bias voltage having a polarity opposite to that of the normal toner, which has been outputted from the first power source section 91, is applied to the upstream cleaning brush 71 via the first bias applying section 75. Consequently, the upstream cleaning brush 71 can electrically attract adhering substances such as the toner charged with the normal polarity, adhering to the surface of the secondary transfer belt 68.

The first bias applying section 75 functions concurrently as a recovering section that electrically attracts and recovers the adhering substances such as toner, etc. having been removed from the second transfer belt 68 by the upstream cleaning brush 71. The adhering substances such as toner, etc. recovered by the first bias applying section 75 are removed from the first bias applying section 75 by a blade 79A, and are accumulated in a receiving member (not shown).

The second bias applying section 76 is formed in a shape of a roller that rotates in contact with the downstream cleaning brush 72. The second bias applying section 76 is electrically connected with a second power source section 92. Then, when a bias voltage is supplied from the second power source section 92, the second bias applying section 76 applies the bias voltage to the downstream cleaning brush 72.

The second power source section 92 outputs a bias voltage (+HV) having a polarity opposite to that of the normal toner. The bias voltage having a polarity opposite to that of the normal toner, which has been outputted from the second power source section 92, is applied to the downstream cleaning brush 72 via the second bias applying section 76. Consequently, the downstream cleaning brush 72 can electrically attract, for recovery, adhering substance such as the toner charged with the normal polarity, adhering to the surface of the secondary transfer belt 68 after having passed through the upstream cleaning brush 71.

Moreover, the absolute value of the bias voltage outputted by the second power source section 92 is set to be not less than the absolute value of the bias voltage outputted by the first power source section 91. That is, the absolute value of the bias voltage applied to the downstream cleaning brush 72 is set to be not less than the absolute value of the bias voltage applied to the upstream cleaning brush 71. Accordingly, the electric attraction force of the upstream cleaning brush 71 is smaller than the electric attraction force of the downstream cleaning brush 72, or is approximately equal to the electric attraction force of the downstream cleaning brush 72.

In this way, in the present embodiment, adhering substances adhering to the surface of the second transfer belt 68 such as the toner charged with the normal polarity, etc. are removed by the upstream cleaning brush 71 and the downstream cleaning brush 72 divided between them. Therefore, bias voltages to be applied to the upstream cleaning brush 71 and the downstream cleaning brush 72 can be set to be relatively low. Thereby, it can be avoided that the toner exceeding the toner recovery function of the upstream cleaning brush 71 enters into the upstream cleaning brush 71.

It should be noted that the absolute value of the bias voltage outputted by the second power source section 92 is preferably approximately 1 to 2 times the absolute value of the bias voltage applied to the upstream cleaning brush 71, in consideration of suppression of discharge from respective brushes 71 and 72. Meanwhile, setting of the bias voltages is determined on the basis of the balance of resistance values of the whole cleaning system including the moving body (the secondary transfer belt 68 in the example) to which toner adheres, recovery rollers (bias applying sections 75 to 77 in the example), or the like.

Furthermore, the second bias applying section 76 functions concurrently as a recovering section that electrically attracts and recovers the adhering substances, such as toner, etc., having been removed from the second transfer belt 68 by the downstream cleaning brush 72. The adhering substances such as toner, etc. recovered by the second bias applying section 76 are removed from the second bias applying section 76 by a blade 79B, and are accumulated in a receiving member (not shown).

The third bias applying section 77 is formed in a shape of a roller that rotates in contact with the cleaning roller 73. The third bias applying section 77 is electrically connected to a third power source section 93. Then, when a bias voltage is supplied from the third power source section 93, the bias applying section 77 applies the bias voltage to the cleaning roller 73.

The third power source section 93 outputs a bias voltage having the same polarity as that of the normal toner (−HV). The bias voltage having the same polarity as that of the normal toner outputted from the third power source section 93 is applied to the cleaning roller 73 via the third bias applying section 77. Because of this, the cleaning roller 73 can electrically attract, for recovery, adhering substances such as toner charged with a polarity opposite to that of the normal toner, adhering to the surface of the secondary transfer belt 68 after having passed through the downstream cleaning brush 72.

Furthermore, the third bias applying section 77 functions concurrently as a recovering section that electrically attracts and recovers the adhering substances, such as toner, etc., having been removed from the second transfer belt 68 by the cleaning roller 73. The adhering substances such as toner, etc. recovered from the cleaning roller 73 by the third bias applying section 77 are removed from the third bias applying section 77 by a blade 79C, and are accumulated in a receiving member (not shown).

[Hardware Configuration of Each Section of Image Forming Apparatus]

Next, a hardware configuration example of each section of the image forming apparatus 1 will be described with reference to FIG. 4.

Figure 4:
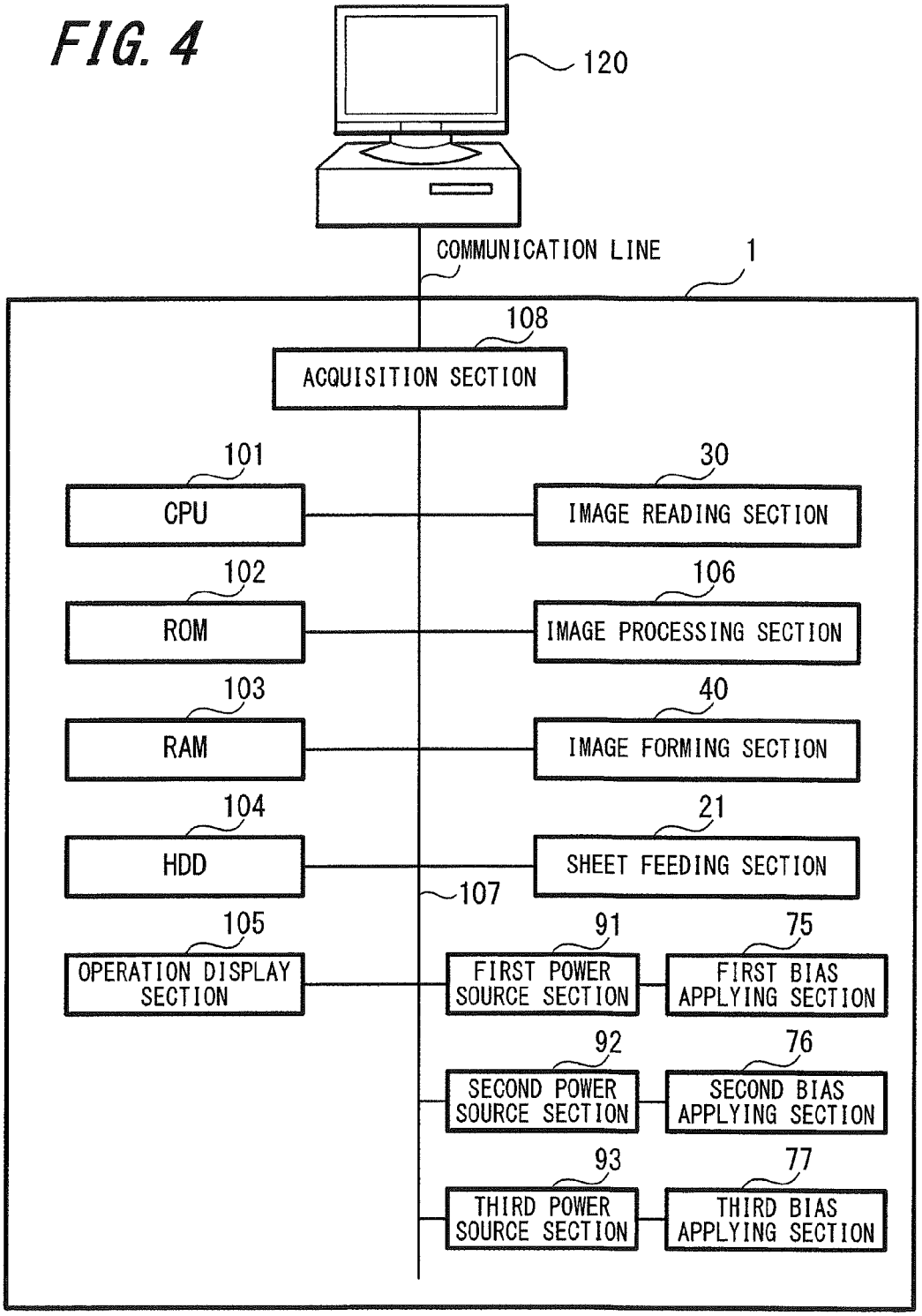
FIG. 4 is a block diagram showing a control system of the first embodiment of the image forming apparatus of the invention.

FIG. 4 is a block diagram showing a control system of the image forming apparatus 1 of the example.

As shown in FIG. 4, the image forming apparatus 1 has, for example, a CPU (Central Processing Unit) 101, and a ROM (Read Only Memory) 102 for storing a program or the like that is executed by the CPU 101. Meanwhile, as the ROM 102, for example, an electrically erasable programmable ROM is used.

Furthermore, the image forming apparatus 1 also has a RAM (Random Access Memory) 103 used as a working area of the CPU 101, a hard disc drive (HDD) 104 as a mass storage device, and an operation display section 105.

The CPU 101, the ROM 102, and the RAM 103 are mounted on the above-mentioned control board 100 (see FIG. 1).

The CPU 101 is an example of a control section, and controls the whole apparatus. Moreover, the CPU 101 is connected to each of the ROM 102, the RAM 103, the HDD 104, and the operation display section 105, via a system bus 107. The CPU 101 is connected to the image reading section 30, an image processing section 106, the image forming section 40, the sheet feeding section 21, the first power source section 91, the second power source section 92, and the third power source section 93, via the system bus 107.

The HDD 104 stores image data of an image of the original document read and obtained by the image reading section 30, and stores image data having been outputted, etc. The operation display section 105 is a touch panel made up of a display such as a liquid crystal display (LCD) or an organic ELD (Electro Luminescence Display). The operation display section 105 displays an instruction menu for a user, information about obtained image data, etc. Furthermore, the operation display section 105 includes a plurality of keys, and accepts input of data, such as various instructions, characters, and numerals, by a key operation of a user, and outputs the input signals.

The image reading section 30 optically reads the image of an original document and converts the same to electric signals. For example, when a color original document is read, the image reading section 30 generates image data having luminance information of RGB (Red, Green, Blue), each in ten bits, per one pixel. The image data generated by the image reading section 30, or image data transmitted from a PC (Personal Computer) 120, an example of an external device connected to the image forming apparatus 1, are received by an acquisition section 108, and are then sent to the image processing section 106 and subjected to image processing. The image processing section 106 performs such processing as analog processing, A/D conversion, shading correction, image compression, etc. for the received image data.

Meanwhile, in the present example, an example in which a personal computer is used as an external device has been described, but the external device is not limited to this, and as the external device, for example, various other devices such as a facsimile device, etc. can be applied.

For example, when color printing is performed through the use of the image forming apparatus 1, R•G•B image data generated by the image reading section 30, etc. are inputted in a color conversion LUT (Look up Table) in the image processing section 106. Then, the image processing section 106 color-converts the R•G•B data into Y•M•C•Bk image data. Then, on the color-converted image data, correction of gradation reproduction properties, screen processing of halftone dots, etc. based on reference to a density correction LUT, edge processing for intensifying a thin line, or the like is performed.

The image forming section 40 receives image data having been subjected to image processing by the image processing section 106, and forms an image on the sheet S based on the image data.

In the image forming apparatus 1 of the embodiment, the toner charged with the normal polarity, adhering to the outer surface of the secondary transfer belt 68, is removed in two steps, by the upstream cleaning brush 71 and the downstream cleaning brush 72 of the cleaning device 70. Accordingly, it is not necessary to remove a large amount of toner adhering to the outer surface of the secondary transfer belt 68 at a time, and thus the bias voltage applied to each of the cleaning brushes 71 and 72 can be kept relatively low. Because of this, induction of discharge can be suppressed, and stress on the cleaning brushes 71 and 72 by discharge products can be reduced.

Furthermore, in the image forming apparatus 1, the absolute value of the bias voltage applied to the downstream cleaning brush 72 of the cleaning device 70 is set to be not less than the absolute value of the bias voltage applied to the upstream cleaning brush 71. Therefore, it is possible to avoid that a disproportional load is placed with respect to removal of toner on the upstream cleaning brush 71. As a result, it is possible to prevent toner of an amount exceeding the toner recovery function of the upstream cleaning brush 71 from entering into the upstream cleaning brush 71, and thereby suppress staying of toner on the upstream cleaning brush 71.

Moreover, in the image forming apparatus 1, a bias voltage having the same polarity as that of the normal toner is applied to the cleaning roller 73, and thus toner charged with a polarity opposite to the normal polarity, and wax and a lubricant added to the toner can be removed by the cleaning roller 73. As a result, generation of filming, in which toner, and wax and a lubricant added to the toner are firmly fixed in a film shape to the surface of the secondary transfer belt 68, can be prevented or suppressed.

2. Second Embodiment of Image Forming Apparatus

[Configuration Example of Image Forming Apparatus]

Next, a configuration example of the second embodiment of the image forming apparatus will be described with reference to FIGS. 5 and 6.

Figure 5:
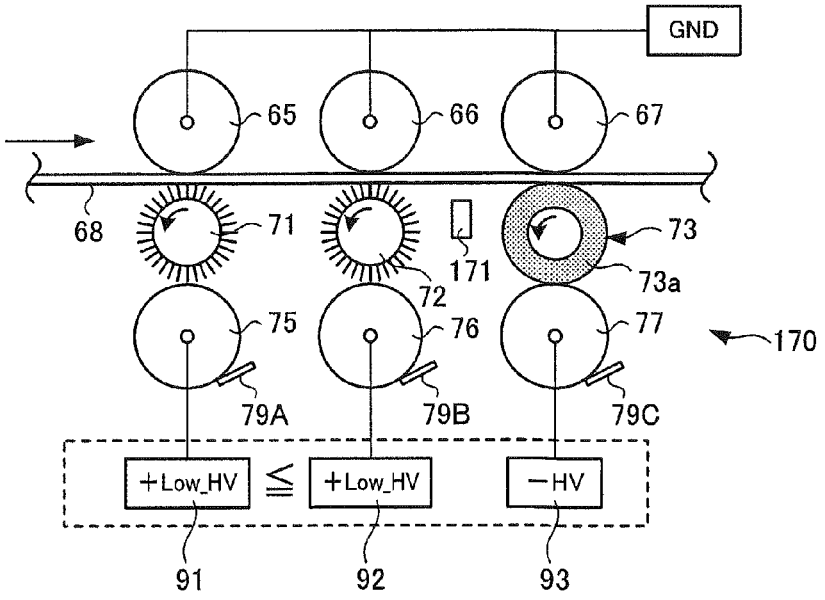
FIG. 5 is a rough configuration diagram showing the principal section of a second embodiment of the image forming apparatus of the invention.

FIG. 5 is a rough configuration diagram of a cleaning device in the second embodiment of the image forming apparatus. FIG. 6 is a block diagram showing a control system in the second embodiment of the image forming apparatus.

An image forming apparatus 151 in the second embodiment (see FIG. 6) has a configuration similar to the configuration of the image forming apparatus 1 in the first embodiment (see FIG. 4). The image forming apparatus 151 differs from the image forming apparatus 1 in that a cleaning device 170 includes a toner charged amount detecting section 171. Accordingly, here, the toner charged amount detecting section 171 of the cleaning device 170 will be described, and sections common in the image forming apparatus 1 are denoted with the same reference numerals, and repeated explanation thereof will be omitted.

The toner charged amount detecting section 171 of the cleaning device 170 shows a specific example of a detecting section for detecting a charged amount distribution of toner. As the toner charged amount detecting section 171, for example, a charged amount distribution measuring device, in which toner particles are deviated by an electric field, and the charged amount distribution of the toner particles is measured from the deviation amount of the toner particles after a certain time, can be applied.

As shown in FIG. 5, the toner charged amount detecting section 171 is arranged between the downstream cleaning brush 72 and the cleaning roller 73. The toner charged amount detecting section 171 detects a charged amount distribution of toner on the secondary transfer belt 68 having passed through the downstream cleaning brush 72.

Figure 6:
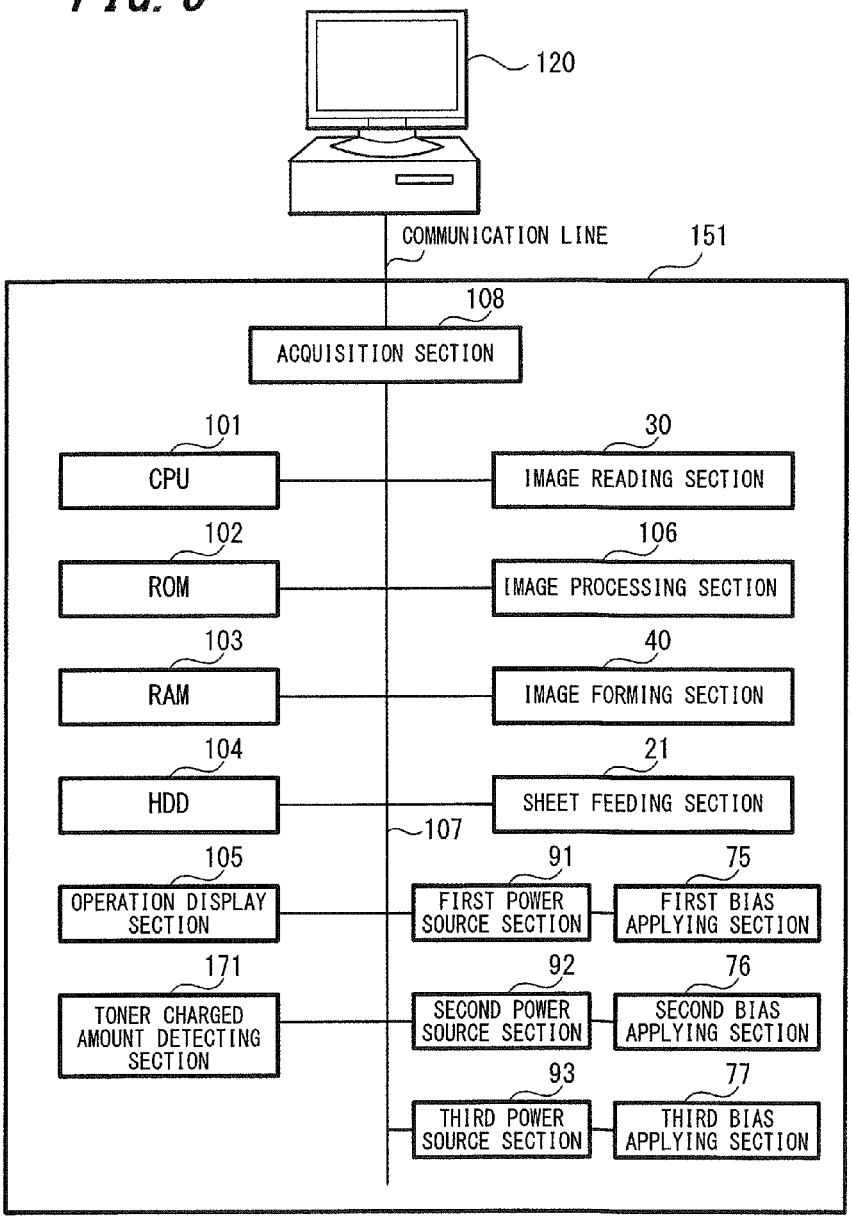
FIG. 6 is a block diagram showing a control system in the second embodiment of the image forming apparatus of the invention.

As shown in FIG. 6, the toner charged amount detecting section 171 is connected to the CPU 101 via the system bus 107. Accordingly, the detection result by the toner charged amount detecting section 171 is supplied to the CPU 101 via the system bus 107. On the basis of the detection result by the toner charged amount detecting section 171, the CPU 101 sets output values in the first power source section 91 and the second power source section 92. The initial setting processing of the output values will be described in "Bias Voltage Setting Processing" to be described later, with reference to FIG. 7.

[Evaluation of Toner Removal Performance]

Here, Table 1 shows an experimental result of examining the relation between the increasing rate of toner charged with a polarity opposite to that of the normal toner, on the secondary transfer belt 68, and the removal performance of the toner, when the bias voltage values are changed.

TABLE 1

| BIAS SETTING [V] | | INCREASING RATE OF TONER HAVING OPPOSITE POLARITY AFTER HAVING PASSED | CLEANING PROPERTY | | RE-ADHERING PROPERTY | | OVERALL EVALUATION | |
|---|---|---|---|---|---|---|---|---|
| FIRST | SECOND | THROUGH SECOND [%] | FIRST | SECOND | FIRST | SECOND | WITHOUT THIRD | WITH THIRD |
| 200 | 200 | 1.1 | x | x | ○ | ○ | x | x |
| | 400 | 1.7 | x | x | ○ | ○ | x | x |
| 400 | 400 | 2.3 | x | Δ | ○ | ○ | x | Δ |
| | 600 | 3.6 | x | ○ | ○ | ○ | x | ○ |
| | 800 | 4.7 | x | ○ | ○ | ○ | x | ○ |
| 600 | 600 | 4.5 | x | ○ | ○ | ○ | x | ○ |
| | 800 | 6.1 | x | ○ | ○ | Δ | x | Δ |
| | 1000 | 7.7 | Δ | ○ | ○ | x | x | x |
| 800 | 800 | 7.1 | ○ | ○ | ○ | x | x | x |
| | 1000 | 9.0 | ○ | ○ | ○ | x | x | x |
| | 1200 | 15.0 | ○ | ○ | ○ | x | x | x |

In Table 1, "First" shows the upstream cleaning brush 71, and "Second" shows the downstream cleaning brush 72. In addition, "Third" shows the cleaning roller 73. As to the increasing rate of the toner charged with a polarity opposite to that of the normal toner, the charged amount distribution of toner on the secondary transfer belt 68 having passed through the downstream cleaning brush 72 is detected by the toner charged amount detecting section 171, and the increasing rate is calculated from the detection result.

"Cleaning property" shown in Table 1 is defined as the removal performance of toner on the secondary transfer belt 68 by each of cleaning brushes 71 and 72. The evaluation of the "Cleaning property" is denoted by "o" when no toner remains on the secondary transfer belt 68, by visual observation. Furthermore, a case where toner remains on the secondary transfer belt 68 by visual observation but there is no practical problem is denoted by "Δ," and a case where toner remains on the secondary transfer belt 68 by visual observation and thus there is a practical problem is denoted by "x."

"Re-adhesion property" shown in Table 1 is defined as transference performance of the toner removed by each of the cleaning brushes 71 and 72 to each of the bias applying sections (recovering rollers) 75 and 76. The evaluation of the "Re-adhesion property" is denoted by "o" when the majority of the toner on each of the cleaning brushes 71 and 72 has moved to each of the bias applying sections 75 and 76, by visual observation. Moreover, a case where toner remains on each of the cleaning brushes 71 and 72 by visual observation but there is no practical problem is denoted by "Δ," and a case where toner remains on each of the cleaning brushes 71 and 72 by visual observation and thus there is a practical problem is denoted by "x."

"Overall evaluation" shown in Table 1 is defined as a combined evaluation of "Cleaning property", "Re-adhesion property", and "Filming property", on the secondary transfer belt 68. In the "Overall evaluation," both cases where the cleaning roller (Third) 73 exists or does not exist were evaluated. Then, cases where "Cleaning property", "Re-adhesion property", and "Filming property" are excellent were evaluated as "0," and cases where there is no practical problem were evaluated as "Δ." In addition, cases where at least one of "Cleaning property", "Re-adhesion property", and "Filming property" has a practical problem were evaluated as "x."

Meanwhile, when the cleaning roller (Third) 73 does not exist, filming occurs, and thus "Filming property" was evaluated as having a practical problem. In contrast, when the cleaning roller (Third) 73 exists, no filming occurs, and thus "Filming property" was evaluated as excellent.

As shown in Table 1, when a bias voltage to be applied to the upstream cleaning brush 71 is 400 V or 600 V, and when a bias voltage to be applied to the downstream cleaning brush 72 is 400 V, 600 V or 800 V, the "Overall evaluation" was excellent or not practically problematic.

Furthermore, when the increasing rate of toner charged with a polarity opposite to that of the normal toner is not more than 6.1%, "Re-adhesion property" was evaluated as excellent or as not practically problematic. As a result, it was found that, when the increasing rate of toner charged with a polarity opposite to that of the normal toner is not more than 6.1%, on the moving body as the object to be cleaned, having passed through a plurality of cleaning brushes, the transfer property of toner from each of the cleaning brushes to the recovery roller becomes optimum.

When "Re-adhesion property" is no good, weakly charged toner transfers from each of the cleaning brushes to the moving body as the object to be cleaned, or toner stays in each of the cleaning brushes. Then, when toner stays in each of the cleaning brushes, each of the cleaning brushes is likely to deteriorate, and the durability of each of the cleaning brushes lowers. Accordingly, it is important to make optimum the transfer property of toner from each of the cleaning brushes to the recovery roller.

Consequently, in the embodiment, the bias voltages that are outputted from the first power source section 91 and the second power source section 92 are set so that the increasing rate of toner with a polarity opposite to that of the normal toner, on the moving body as the object to be cleaned after having passed through a plurality of cleaning brushes, becomes not more than 6.0%. Meanwhile, the increasing rate of toner charged with a polarity opposite to that of the normal toner may be set to become not more than 6.1%.

[Bias Voltage Setting Processing]

Next, a bias voltage setting processing will be described with reference to FIG. 7.

Figure 7:
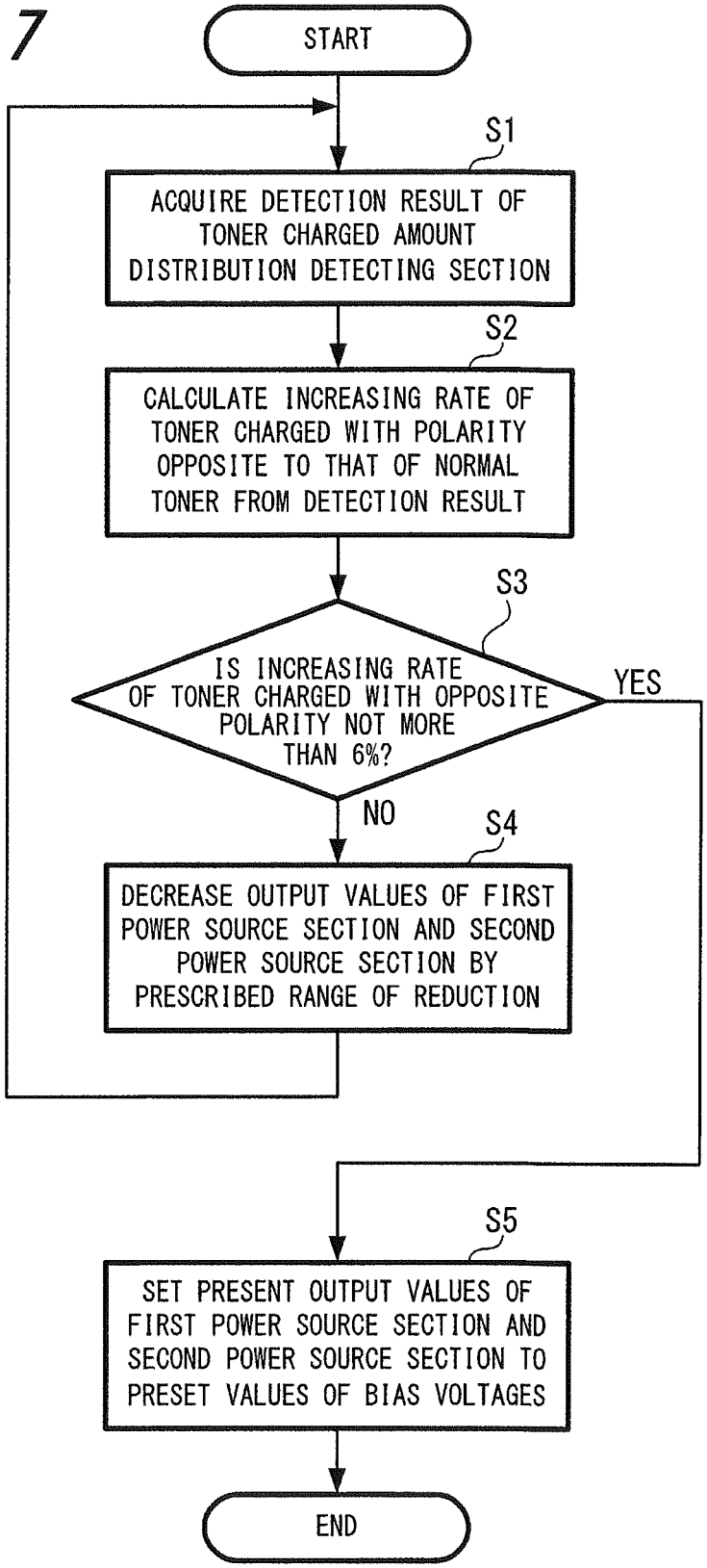
FIG. 7 is a flowchart showing a bias voltage setting processing according to the second embodiment of the image forming apparatus of the invention.

FIG. 7 is a flowchart showing a bias voltage setting processing of the present embodiment.

Before performing the bias voltage setting processing, as output values of the bias voltages, predetermined initial values are inputted. Then, in the bias voltage setting processing, whether or not the initial values are appropriate is determined, and, when they are not appropriate, the preset values of the bias voltages are changed. The bias voltage setting processing is executed, for example, before shipping of the image forming apparatus 151, or after exchange of the cleaning brush 71 or 72, the bias applying section 75 or 76, or the secondary transfer belt 68.

When the bias voltage setting processing is started, first, the CPU 101 obtains a detection result of the toner charged amount detecting section 171 (Step S1). The toner charged amount detecting section 171 detects the charged amount distribution of toner charged with a polarity opposite to that of the normal toner, on the secondary transfer belt 68.

Next, the CPU 101 calculates the increasing rate of the toner charged with a polarity opposite to that of the normal toner from the detection result of the toner charged amount detecting section 171 (Step S2). In the processing, the charged amount distribution of the toner charged with a polarity opposite to that of the normal toner on the secondary transfer belt 68 before passing the upstream cleaning brush 71 is previously detected, and from a detection result thereof and a detection result of the toner charged amount detecting section 171, the increasing rate of the toner charged with a polarity opposite to that of the normal toner is calculated. Accordingly, in the example, it may be convenient to arrange a toner charged amount distribution detection section for detecting the charged amount distribution of toner charged with a polarity opposite to that of the normal toner on the second transfer belt 68, between the nip section formed by the secondary transfer roller 61 of the second transfer section 60 and the intermediate transfer belt 50, and the upstream cleaning brush 71.

Subsequently, the CPU 101 determines whether or not the increasing rate of toner charged with a polarity opposite to that the normal toner is not more than 6% (Step S3). When the CPU 101 decides that the increasing rate of toner charged with a polarity opposite to that the normal toner is more than 6%, the CPU 101 decreases each output value of the first power source section 91 and the second power source section 92, by a prescribed range of reduction (for example, 50 V) (Step S4). After that, the CPU 101 transfers the processing to the Step S1.

When the CPU 101 determines in the processing of Step S3 that the increasing rate of toner charged with a polarity opposite to that of the normal toner is not more than 6%, the CPU 101 sets the present output values of the first power source section 91 and the second power source section 92, to the preset values of the bias voltages (Step S5). After that, the CPU 101 terminates the bias voltage setting processing.

By the bias voltage setting processing, bias voltages to be applied to each of the cleaning brushes 71 and 72 are set to be values that can ensure respective electric attraction forces of the cleaning brushes 71 and 72 and that can make optimum the transferring property of toner to each of the bias applying sections (recovering rollers) 75 and 76. As a result, the durability of each of the cleaning brushes 71 and 72 can be improved.

Meanwhile, in the processing in Step S4 of the bias voltage setting processing, ranges of reduction in output values were set to be the same in the first power source section 91 and in the second power source section 92. However, the ranges of reduction in the output values may be different in the first power source section and in the second source section according to the invention.

3. Third Embodiment of Image Forming Apparatus

[Configuration Example of Image Forming Apparatus]

Next, a configuration example of the third embodiment of the image forming apparatus will be described with reference to FIGS. 8 and 9.

Figure 8:
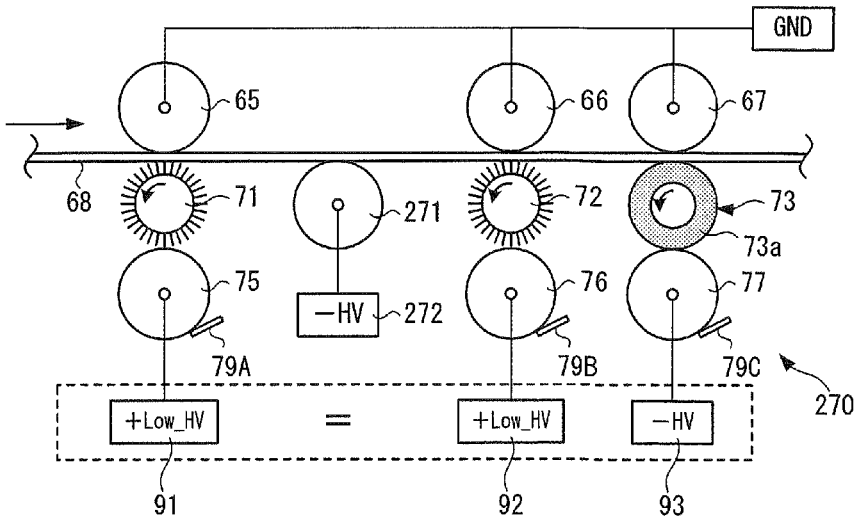
FIG. 8 is a rough configuration diagram showing a cleaning device according to a third embodiment of the image forming apparatus of the invention.

FIG. 8 is a rough configuration diagram showing a cleaning device in the third embodiment of the image forming apparatus. FIG. 9 is a block diagram showing a control system in the third embodiment of the image forming apparatus.

An image forming apparatus 201 in the third embodiment (see FIG. 9) has a configuration similar to the configuration of the image forming apparatus 1 in the first embodiment (see FIG. 4). The image forming apparatus 201 is different from the image forming apparatus 1 in that a cleaning device 270 includes a charge applying section 271. Accordingly, here, the charge applying section 271 of the cleaning device 270 will be described, and the same reference numerals are given to sections common to the image forming apparatus 1 and repeated description will be omitted.

As shown in FIG. 8, the charge applying section 271 of the cleaning device 270 is arranged between the upstream cleaning brush 71 and the downstream cleaning brush 72. The charge applying section 271 applies a charge having the same polarity as that of the normal toner, to adhering substances such as toner, etc. adhering to the surface of the secondary transfer belt 68 having passed through the upstream cleaning brush 71. Examples of the charge applying section 271 can include a roller, a brush, and a charger.

Figure 9:
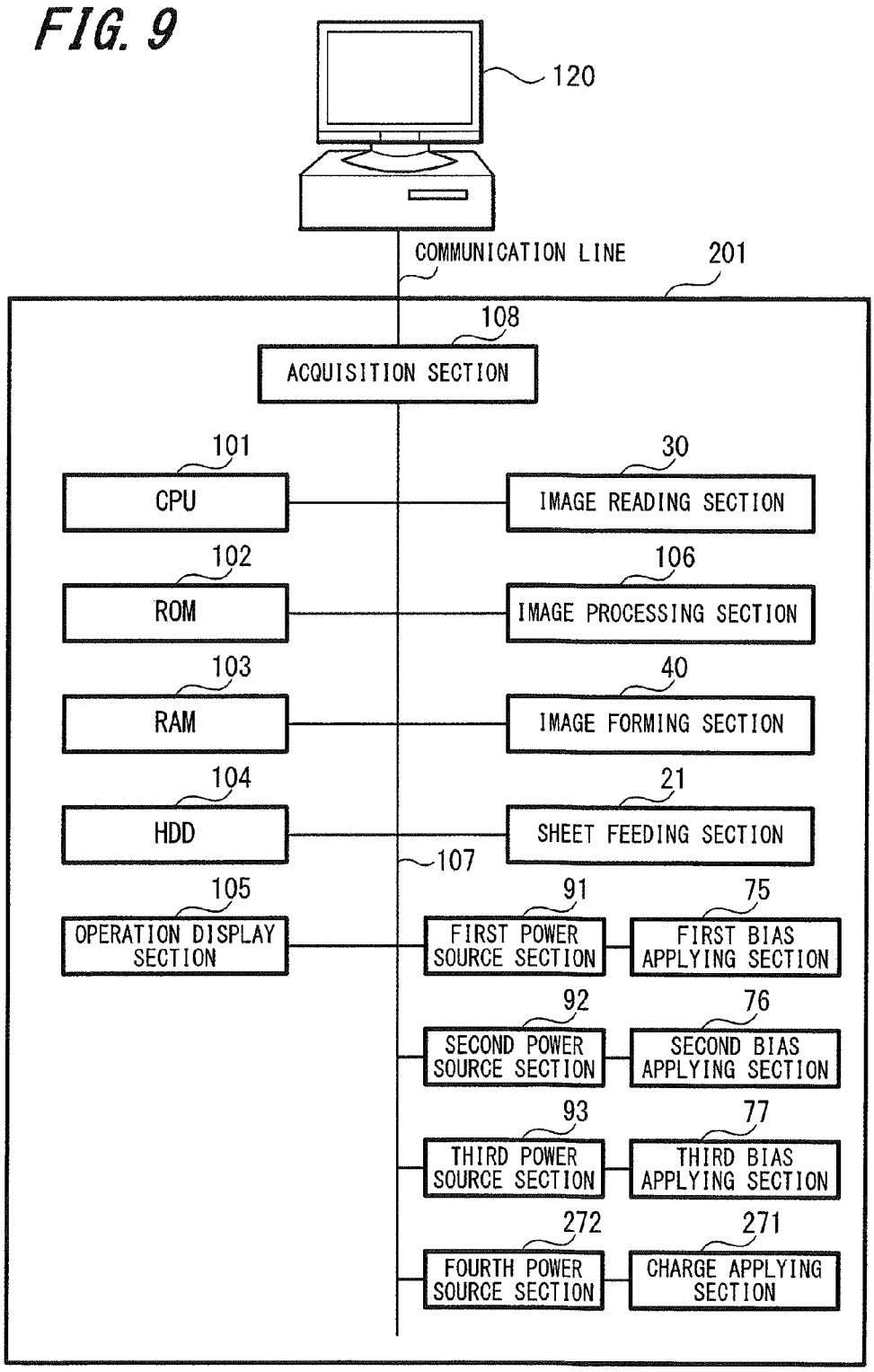
FIG. 9 is a block diagram showing the control system of the third embodiment of the image forming apparatus of the invention.

As shown in FIG. 9, the charge applying section 271 is electrically connected to a fourth power source section 272. Then, the fourth power source section 272 is connected to the CPU 101 via the system bus 107. The fourth power source section 272 is driven and controlled by the CPU 101, and outputs a bias voltage having the same polarity (−HV) as that of the normal toner. Consequently, the charge applying section 271 can apply a charge having the same polarity as that of the normal toner, to adhering substances such as the toner charged with the same polarity as that of the normal toner, which adheres to the surface of the secondary transfer belt 68.

Adhering substances, such as toner, etc., adhering to the surface of the secondary transfer belt 68 having passed through the upstream cleaning brush 71, discharge to some degree when having passed through the upstream cleaning brush 71. Consequently, the charged amount of adhering substances, such as toner, etc., charged with the same polarity as that of the normal toner, adhering to the surface of the secondary transfer belt 68 having passed through the upstream cleaning brush 71, is reduced.

Therefore, before passing through the downstream cleaning brush 72, the charge applying section 271 applies a charge having the same polarity as that of the normal toner, to the adhering substances such as toner, etc. adhering to the surface of the secondary transfer belt 68. Because of this, even when the bias voltage applied to the downstream cleaning brush 72 is set to be not higher than the bias voltage applied to the upstream cleaning brush 71, adhering substances such as toner, etc. adhering to the surface of the secondary transfer belt 68 can surely be removed by the downstream cleaning brush 72.

In addition, since bias voltages applied to the upstream cleaning brush 71 and the downstream cleaning brush 72 can be set equal to each other, loads applied to the upstream cleaning brush 71 and the downstream cleaning brush 72 can be made uniform. As a result, the durability of the upstream cleaning brush 71 and the downstream cleaning brush 72 can be improved.

In the embodiment, the charge applying section 271 is arranged between the upstream cleaning brush 71 and the downstream cleaning brush 72, and a charge having the same polarity as that of the normal toner is given to adhering substances such as toner, etc. adhering to the surface of the secondary transfer belt 68, before passing through the downstream cleaning brush 72. However, the cleaning device and the image forming apparatus of the present invention may be of such a configuration that an upstream charge applying section for applying a charge having the same polarity as that of the normal toner to adhering substances such as toner, etc. adhering to the surface of the secondary transfer belt 68 before passing through the upstream cleaning brush 71 is added. Consequently, also in the upstream cleaning brush 71, the removal of adhering substances such as toner, etc. adhering to the surface of the secondary transfer belt 68 can be stably performed.

In addition, as to the cleaning device 270 of the present embodiment, the configuration in which the charge applying section 271 is added to the cleaning device 70 in the first embodiment (see FIG. 3), has been described as an example. However, the cleaning device of the invention may have a configuration that the charge applying section 271 is added to the cleaning device 170 in the second embodiment. Furthermore, the image forming apparatus of the present embodiment may have a configuration that the charge applying section 271 and the fourth power source section 272 are added to the image forming apparatus 151 in the second embodiment.

4. Fourth Embodiment of Image Forming Apparatus

[Configuration Example of Image Forming Apparatus]

Next, a configuration example of the fourth embodiment of the image forming apparatus will be described with reference to FIG. 10.

Figure 10:
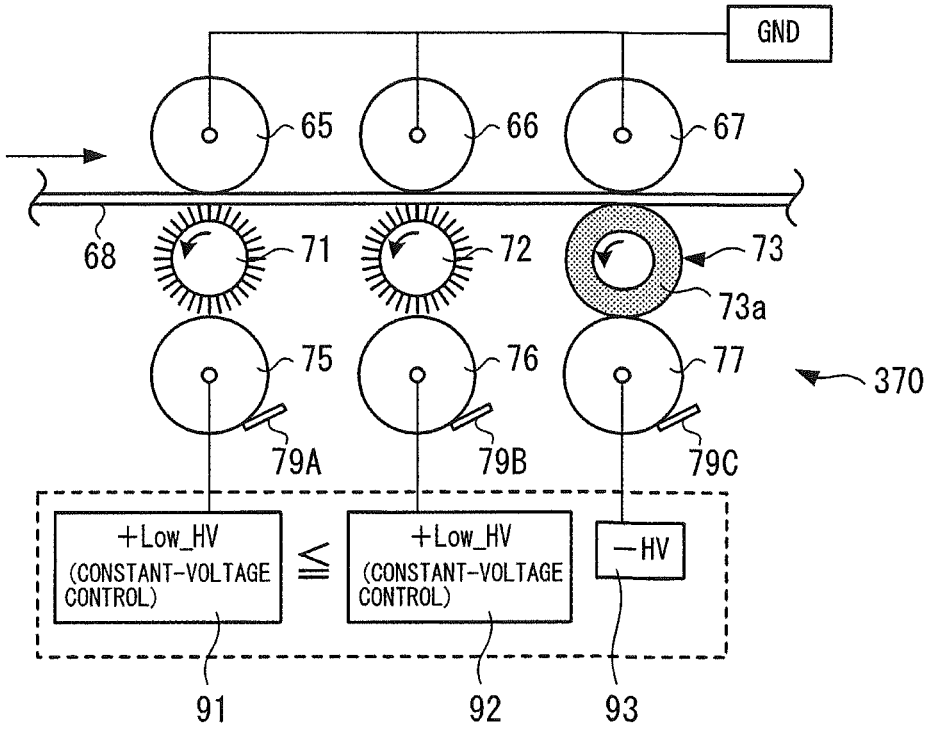
FIG. 10 is a rough configuration diagram showing a cleaning device according to a fourth embodiment of the image forming apparatus of the invention.

FIG. 10 is a rough configuration diagram showing a cleaning device in the fourth embodiment of the image forming apparatus.

The image forming apparatus in the fourth embodiment has a configuration similar to the configuration of the image forming apparatus 1 in the first embodiment (see FIG. 1). The image forming apparatus in the fourth embodiment is different from the image forming apparatus 1 in terms of the control method of the first power source section 91 and the second power source section 92. Accordingly, here, the control method of the first power source section 91 and the second power source section 92 will be described.

The first power source section 91 and the second power source section 92 of a cleaning device 370 of the image forming apparatus in the fourth embodiment are constant-voltage controlled by the CPU 101. The absolute value of the bias voltage outputted by the second power source section 92 is set to be not less than the absolute value of the bias voltage outputted by the first power source section 91. That is, the absolute value of the bias voltage to be applied to the downstream cleaning brush 72 is set to be not less than the absolute value of the bias voltage to be applied to the upstream cleaning brush 71.

Here, the relation between the voltages and currents of biases to be applied to the cleaning brushes 71 and 72 will be described with reference to FIG. 11.

Figure 11:
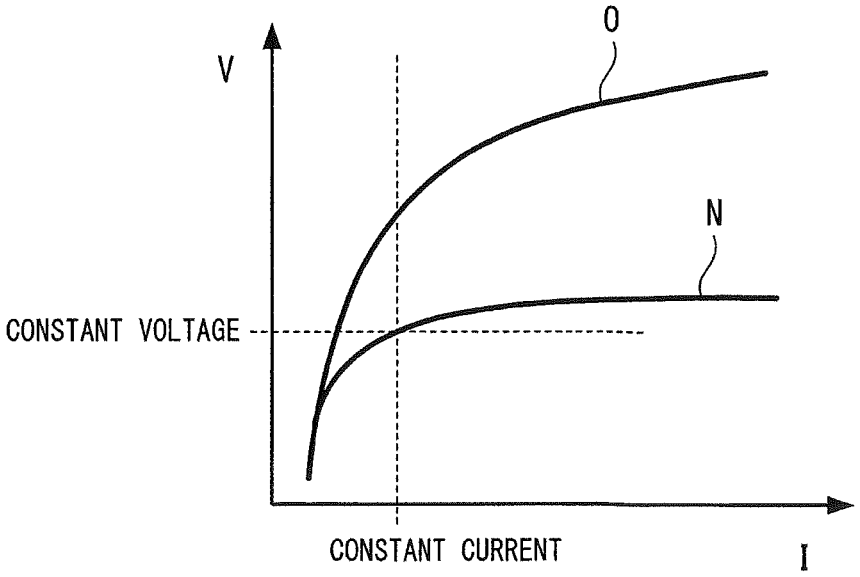
FIG. 11 is a graph showing a relation between voltage and current of a bias applied to a cleaning brush.

FIG. 11 is a graph showing the relation between the voltage and current of bias to be applied to the cleaning brush.

A curved line N shown in FIG. 11 shows the relation between the voltage and current when bias is applied to a new cleaning brush, and a curved line ○ shows the relation between the voltage and current when bias is applied to a cleaning brush having been used for a certain period.

As shown in FIG. 11, a cleaning brush having been used for a certain period (shown by the curved line ○) deteriorates and has a resistance larger than a resistance of a new cleaning brush (shown by the curved line N). Accordingly, when a constant-current control is performed, in which the current of the bias applied to the cleaning brush is controlled so as to be constant, the voltage of the bias to be applied to the cleaning brush becomes larger with prolonged use of the cleaning brush.

Since toner is sensitive to a voltage (potential), the voltage contributes largely to the electric attraction force by the cleaning brush relative to toner. Consequently, when the bias to be applied to the cleaning brush is subjected to constant-current control, the voltage of the bias becomes increased during the use, and the electric attraction force by the cleaning brush relative to toner becomes increased. Consequently, for example, the amount of toner removed by the upstream cleaning brush becomes larger, and the toner easily stays on the upstream cleaning brush.

Accordingly, the biases to be applied to the upstream cleaning brush 71 and the downstream cleaning brush 72 are preferably set to be constant-voltage control in which the voltage is controlled to be constant. Consequently, variations of the voltages of biases to be applied to the upstream cleaning brush 71 and the downstream cleaning brush 72 can be suppressed. As a result, adhering substances such as toner, etc. adhering to the surface of the secondary transfer belt 68 can be stably removed.

The cleaning device 370 in the present embodiment adopts the same configuration as the cleaning device 70 in the first embodiment (see FIG. 3). However, outputs of the first power source section 91 and the second power source section 92 of the cleaning device 170 in the second embodiment or of the cleaning device 270 in the third embodiment may be constant-voltage controlled. In addition, outputs of the first power source section 91 and the second power source section 92 of a cleaning device having such a configuration in which the charge applying section 271 in the third embodiment is added to the cleaning device 170 of the second embodiment may be constant-voltage controlled.

Hereinbefore, embodiments of the cleaning device and the image forming apparatus have been described, including the operation/working effect thereof. However, the cleaning device and the image forming apparatus of the present invention are not limited to the above-mentioned embodiments, but various modifications are possible within a scope not departing from the gist of the invention described in the claims.

For example, the above-mentioned first to fourth embodiments have a configuration provided with two cleaning brushes 71 and 72. However, the cleaning device and the image forming apparatus of the present invention may have a configuration provided with not less than three cleaning brushes.

In this case, to all cleaning brushes, a bias voltage having a polarity opposite to that of the polarity of the normal toner is applied. Then, the absolute value of the bias voltage to be applied to the cleaning brush arranged on the downstream side between adjacent cleaning brushes is set to be not less than the absolute value of the bias voltage to be applied to the cleaning brush arranged on the upstream side.

Furthermore, the above-mentioned first to fourth embodiments have a configuration provided with one cleaning roller 73. However, the cleaning device and the image forming apparatus of the invention may have a configuration provided with not less than two cleaning rollers.

Moreover, in the above-mentioned first to fourth embodiments, the secondary transfer belt 68 is defined as the moving body to which toner, etc. adhere. However, the moving body according to the present invention to which toner, etc. adhere may be, for example, a photosensitive body or an intermediate transfer belt.

It should be understood by those skilled in the art that various modifications, combinations, sub-combinations and alterations may occur depending on design requirements and other factors insofar as they are within the scope of the appended claims or the equivalents thereof.

What is claimed is:

1. A cleaning device, comprising:

an upstream cleaning brush that contacts a surface of a moving body to which toner adheres;

a downstream cleaning brush that is arranged on a downstream side of the upstream cleaning brush in a moving direction of the moving body and that contacts a surface of the moving body;

a cleaning roller that is arranged on a downstream side of the downstream cleaning brush in a moving direction of the moving body and that contacts a surface of the moving body;

a first bias applying section that applies a bias voltage having a polarity opposite to that of normal toner to the upstream cleaning brush;

a second bias applying section that applies a bias voltage to the downstream cleaning brush, the bias voltage having a polarity opposite to that of normal toner and being set to be not less than an absolute value of a bias voltage applied to the upstream cleaning brush; and a third bias applying section that applies a bias voltage having the same polarity as that of normal toner to the cleaning roller.

2. The cleaning device according to claim 1, wherein each of the bias voltages applied to the upstream cleaning brush and the downstream cleaning brush is set so that an increasing rate of toner having a polarity opposite to that of normal toner on a surface of the moving body after having passed through the downstream cleaning brush becomes not more than 6% compared to the toner having a polarity opposite to that of normal toner on a surface of the moving body before passing the upstream cleaning brush.

3. The cleaning device according to claim 1, further comprising a charge applying section that is arranged between the upstream cleaning brush and the downstream cleaning brush and that applies a charge having the same polarity as that of normal toner to toner adhering to a surface of the moving body.

4. The cleaning device according claim 1, further comprising an upstream charge applying section that is arranged on an upstream side of the upstream cleaning brush in a moving direction of the moving body and that applies a charge having the same polarity as that of normal toner to toner adhering to a surface of the moving body.

5. The cleaning device according to claim 1, wherein the first bias applying section and the second bias applying section are subjected to constant-voltage control.

6. The cleaning device according to claim 1, further comprising:

a detection section that is arranged on a downstream side of the downstream cleaning brush in a moving direction of the moving body and that detects a charged amount distribution of toner on a surface of the moving body; and a control section that set values of bias voltages applied to the upstream cleaning brush and the downstream cleaning brush so that an increasing rate of toner having a polarity opposite to that of the normal toner on a surface of the moving body after having passed through the downstream cleaning brush becomes not more than 6% compared to the toner having a polarity opposite to that of normal toner on a surface of the moving body before passing the upstream cleaning brush, on the basis of a detection result of the detection section.

7. An image forming apparatus, comprising:

a moving body to a surface of which toner adheres; and a cleaning device that removes toner adhering to the moving body, the cleaning device including;

an upstream cleaning brush that contacts a surface of the moving body;

a downstream cleaning brush that is arranged on a downstream side of the upstream cleaning brush in a moving direction of the moving body and that contacts a surface of the moving body;

a cleaning roller that is arranged on a downstream side of the downstream cleaning brush in a moving direction of the moving body and that contacts a surface of the moving body;

a first bias applying section that applies a bias voltage having a polarity opposite to that of normal toner to the upstream cleaning brush;

a second bias applying section that applies a bias voltage to the downstream cleaning brush, the bias voltage having a polarity opposite to that of normal toner and being set to be not less than an absolute value of a bias voltage applied to the upstream cleaning brush; and a third bias applying section that applies a bias voltage having the same polarity as that of normal toner to the cleaning roller.

8. The image forming apparatus according to claim 7, wherein each of the bias voltages applied to the upstream cleaning brush and the downstream cleaning brush is set so that an increasing rate of toner having a polarity opposite to that of normal toner on a surface of the moving body after having passed through the downstream cleaning brush becomes not more than 6% compared to the toner having a polarity opposite to that of normal toner on a surface of the moving body before passing the upstream cleaning brush.

9. The image forming apparatus according to claim 7, further comprising a charge applying section that is arranged between the upstream cleaning brush and the downstream cleaning brush and that applies a charge having the same polarity as that of normal toner to toner adhering to a surface of the moving body.

10. The image forming apparatus according to claim 7, further comprising an upstream charge applying section that is arranged on an upstream side of the upstream cleaning brush in a moving direction of the moving body and that applies a charge having the same polarity as that of normal toner to toner adhering to a surface of the moving body.

11. The image forming apparatus according to claim 7, wherein the first bias applying section and the second bias applying section are subjected to constant-voltage control.

* * * * *